United States Patent [19]

Strauss

[11] 3,963,059

[45] June 15, 1976

[54] BEATING-UP ARRANGEMENT FOR A WAVE-TYPE WEAVING MACHINE

[75] Inventor: Edgar Strauss, Ruti, Zurich, Switzerland

[73] Assignee: Ruti Machinery Works Ltd., Ruti, Zurich, Switzerland

[22] Filed: Nov. 22, 1974

[21] Appl. No.: 526,159

[30] Foreign Application Priority Data

Nov. 29, 1973 Switzerland ..... 16790/73

[52] U.S. Cl. ..... 139/436; 139/191

[51] Int. Cl.[2] ..... D03D 47/26

[58] Field of Search ..... 139/12, 13, 79, 80, 139/190, 191; 74/567

[56] References Cited

UNITED STATES PATENTS

| | | | |
|---|---|---|---|
| 2,845,093 | 7/1958 | Dietzsch et al. | 139/12 |
| 3,124,165 | 3/1964 | Slayter et al. | 139/12 |
| 3,688,806 | 9/1972 | Strauss | 139/12 |
| 3,809,130 | 5/1974 | Strauss et al. | 139/12 |

*Primary Examiner*—Henry S. Jaudon
*Attorney, Agent, or Firm*—Donald D. Denton

[57] ABSTRACT

The present invention relates to a wave-type weaving machine with reed teeth which are arranged along an axis and are adapted to pivot about the said axis, abut with some play on cam-like guide surfaces and, on rotation of the guide surfaces, carry out pivoting movements about the said axis, the reed teeth beating-up the weft thread in one of the end positions of the said teeth.

5 Claims, 4 Drawing Figures

Fig. 1

BEATING-UP ARRANGEMENT FOR A WAVE-TYPE WEAVING MACHINE

BACKGROUND

In known wave-type weaving machines, the reed teeth are moved individually and the beating-up of the weft thread takes place over the width of the weaving machine continuously at individual regions. In the interests of good quality of the weave, the beating-up should take place at the same height at all the reed teeth. As a result, the beat-up line is given a straight course. Therefore, the pivoting movement is given to the reed teeth by means of a positive guide. But this must be provided with some play. The reason is that, in the case of an arrangement operating without any play, there would be a danger of overstressing some of the parts, since the reed teeth can be jammed under such conditions or even deformed.

In their beating-up movement, the reed teeth undergo a rapid decrease in speed and lose contact with the driving surface as a result of the play. The amount to which this contact is lost depends on the friction of the individual reed teeth and the force which is necessary for the beating-up. More particularly in the case of fabrics with a low weft density, a curved or undulating beat-up line can result. The aforesaid disadvantages are more likely to occur the faster the weaving machine is operated.

To obviate these disadvantages it is known to provide an elastic material against which the reed teeth strike shortly before reaching the beat-up position of the said reed teeth. By this measure, some progress is in fact made, but it is still necessary to tolerate some irregularities. If the elastic material is subjected to considerable stress, it forms an additional load on the driving arrangement. It also has the result that the distance required for stopping the reed teeth depends on the speed of the reed teeth. As a result, when the weaving machine is started, markings are produced in the fabric; finally, the stopping characteristic of the elastic material is different at different speed ranges of the reed teeth. This discussion is not intended to imply that providing an elastic material is always disadvantageous. The elastic material is found to be advantageous in particular if it is used to a suitably limited extent.

In connection with this application, the applicant is unaware of the existence of prior patented art.

SUMMARY

According to the present invention a satisfactory beat-up edge is to be obtained in a fabric in that in the guide surfaces, in the region which corresponds to be movement of the corresponding reed tooth towards its beating-up position, in a first part-region, there is a relatively considerable variation of the spacing of the guide surface from its axis of rotation; and in a subsequent second part-region, which merges into the portion of the guide surface corresponding to the beat-up position of the reed tooth, there is a linear variation of the spacing of the guide surface from its axis of rotation, which is smaller than the variation of the first part-region.

A further advantage of the present invention is also that in the present invention the spacing of the place at which the weft thread leaves the weft thread insertion element to the place at which it is beaten-up is relatively large. As a result, the thread can be stretched out over a relatively considerable distance and thus can be freed of any small loops which might be present.

DESCRIPTION OF PREFERRED EMBODIMENT

The invention will now be explained in detail with reference to the drawings and with the use of examples of embodiments. In the drawings.

Figure 1:
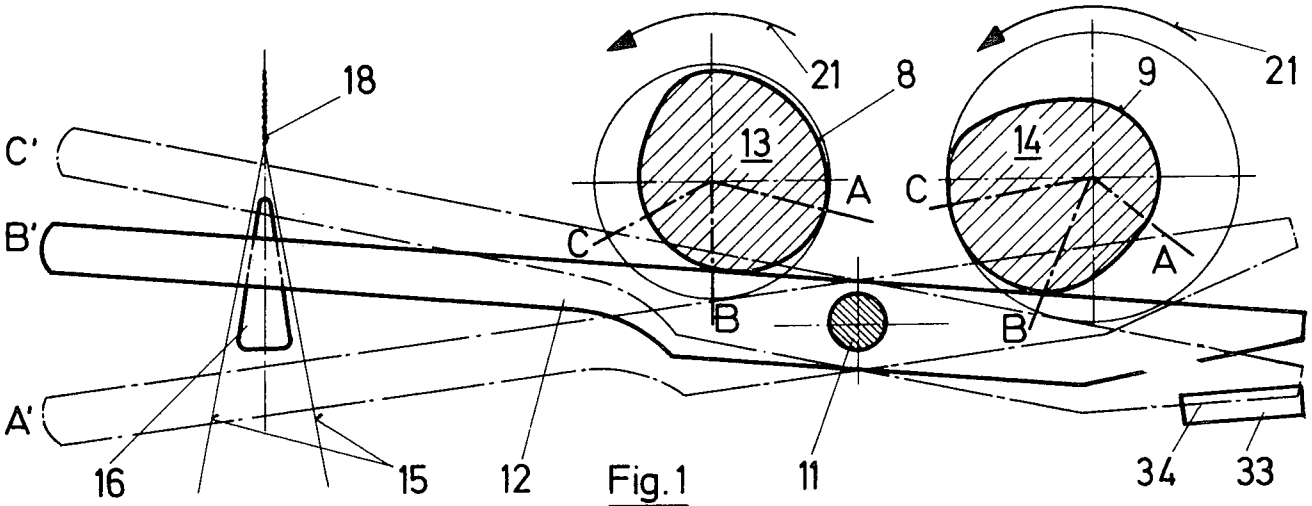
FIG. 1 shows a view in section at right angles to the axis about which the reed teeth are pivotably arranged.
Figure 2:
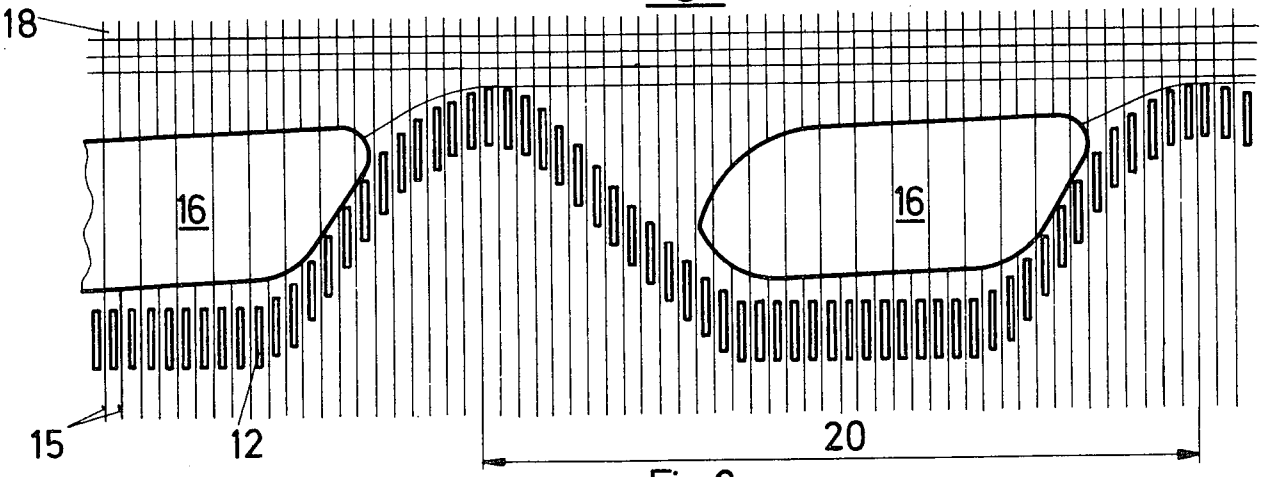
FIG. 2 shows a view of some of the reed teeth as seen from the front of a weaving machine.

In a wave-type weaving machine or loom as shown in the drawings, a large number of reed teeth 12 are arranged along a spindle 11 in such a manner that they can be pivoted about the said spindle. The teeth are in the form of flat strips or blades and the wide sides are situated side by side with small spacings between them. By means of two shafts 13, 14, each of which has a helical profile and an eccentric cross-section, the reed teeth 12 are given a pivoting controlled movement. Each reed tooth 12 abuts against the guide surfaces 8, 9 which are cam-like surfaces that extend over the periphery of the helical shafts 13 and 14 respectively. The two end positions A′ and C′ of the reed teeth 12 are shown in dot-dash lines in FIG. 1 of the drawings. These two positions are reached when the angles A and C abut on the reed tooth 12 respectively. The full-line position B′ of the reed tooth corresponds to the abutment of the angles B on the reed tooth 12. The angle between the position A, B is approximately equal to the angle between positions B, C. The reed teeth 12 extend through sheds 15 which are formed from warp threads and through which run the shuttles 16 which are used for inserting the weft threads 17 (FIG. 2). The woven material formed during the weaving operation is designated as 18.

The profile of the cam-like surfaces of the helical shafts 13, 14 is so selected that the reed teeth 12, apart from a little play, bear continuously on the surface of the two helical shafts 13, 14 and thus are positively guided in their degree of pivoting about spindle 11. The profile has a repeating periodicity in the axial direction and has such a shape that the ends of the reed teeth 12 projecting from the shed 15 have the pattern shown in FIG. 2 of the drawings. FIG. 2 shows a view of some of the reed teeth 12 in a known weaving machine as seen from the left-hand side in FIG. 1 or from the front of the weaving machine. The pattern of the reed teeth 12 comprises in the axial direction a periodicity which is repeated over a length 20 and which is given by the shape of the profiles of the helical shafts 13, 14 so that the periodicity of the latter is also repeated after each length 20. In other words, the pitch of the profile of the helical shafts 13, 14 is also equal to the length 20. Between each two undulation crests of the pattern formed by the ends of the reed teeth 12, there is located a shuttle 16. This lies on the reed teeth 12, which form the undulation valley in the pattern formed by the reed teeth ends. The pivoting movement of each reed tooth 12 is brought about by the narrow guide surfaces 8, 9 of the helical shaft 13, 14 against which the reed teeth come to abut during rotation of the said shafts. On rotation of the helical shafts 13, 14 in the direction of the arrows 21, the reed teeth 12 carry out pivoting movements in such a manner that in their entirety they form a wave which travels from right to left (see FIG. 2).

Figure 3:
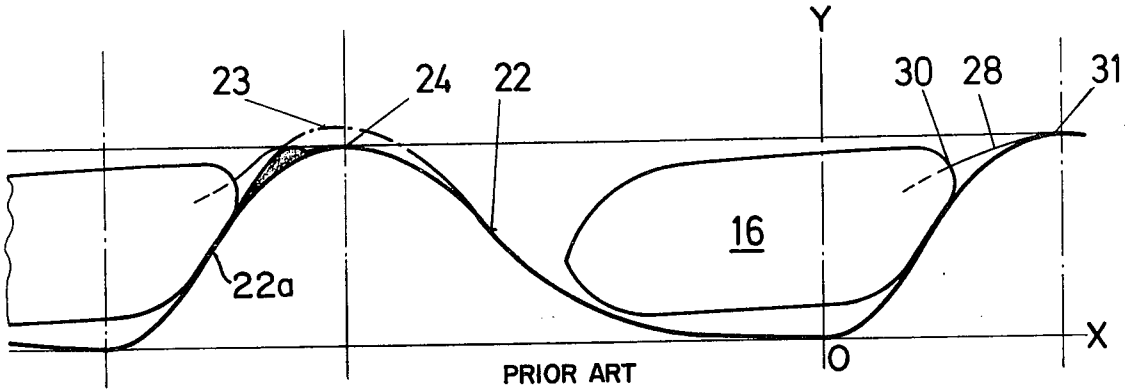
PRIOR ART Fig. 3
FIG. 3 and FIG. 4 are graphical-type illustrations used to show and compare the results produced by the beat-up arrangement of the invention over those in a known wave-type weaving machine.

The pattern of the ends of the reed teeth 12 in a known wave-type weaving machine is again illustrated diagrammatically as a curve 22 in FIG. 3. As already mentioned, the curve represents the position of the ends of the reed teeth 12, looking towards the weaving machine. But the curve 22 can also be regarded as a representation of the movement of the end of an individual reed tooth. In this case the time is plotted on the *x*-axis and the travel of the reed tooth end on the *y*-axis. Thus the end describes a sinusoidal half-oscillation and remains in approximately its lower position during a certain period of time.

When operating the weaving machine, the ends of the reed teeth 12 travel at a relatively high speed in the rising section 22*a*. Due to the play provided for the reed teeth as mentioned at the beginning of the description, these can be carried to the height of the curve section 23 (shown in dot-dash line) in the case of loose fabrics and therefore small beating-up forces. Depending on conditions, the maximum height of the teeth extends somewhere into the region between the curves 23 and 24. It may fluctuate, resulting in a curved beat-up line on the fabric.

Figure 4:
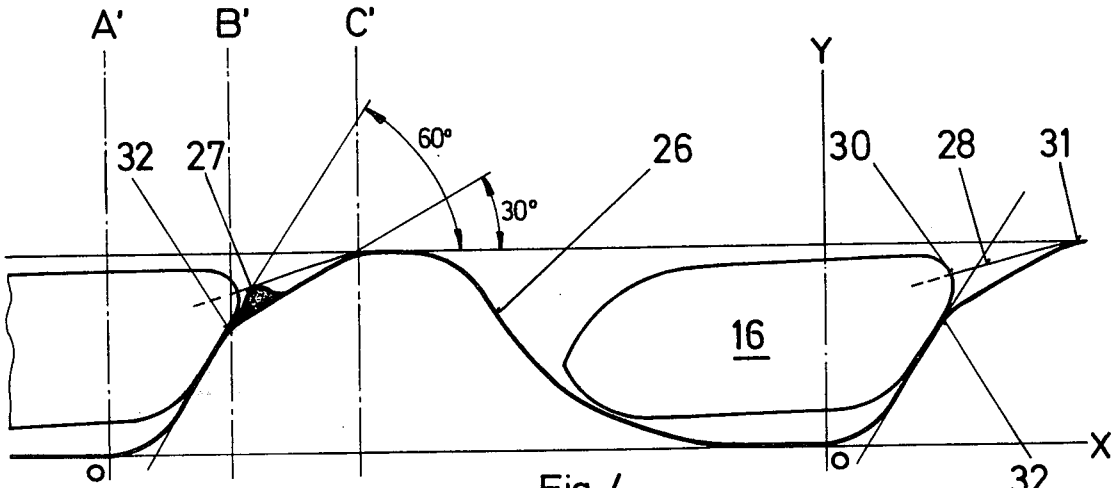

According to the present invention the reed teeth are given a movement of the kind shown by the curve 26 shown in FIG. 4. This illustration also can be regarded in such a manner that the curve 26 shows the pattern of the ends of the reed teeth or in such a manner that the time is plotted on the *x*-axis and the movement of the end of a reed tooth 12 on the *y*-axis. The positions A′, B′ and C′ of the reed tooth 12 shown in FIG. 1 are also shown in FIG. 4. It will be seen from the illustration that with the movement shown by the curve 26 according to the present invention, the reed tooth 12 is moved relatively quickly upwards between the positions A′ and B′. Between the positions B′ and C′ it is moved in a linear, uniform and relatively slower movement until it strikes against the fabric. In the region of the position B′ the speed of the reed tooth 12 is slowed down. As a result, the over-shooting of the reed teeth 12 represented in FIG. 3 by the curves 23, 24 and caused by the play of the teeth 12, takes place in the region directly following position B′, as is shown by the curve section 27. This over-shooting of the reed teeth 12 at the region B′, however, has no influence at all on the beating-up of the fabric. Owing to the linear pattern of the drive and more particularly the relatively slow speed of the reed tooth ends between the positions B′ and C′, there is no over-shooting of the reed tooth ends in the region after the position C′. As a result the beat-up edge of the fabric is straight and substantially independent of differences which may exist in the arrangement or in the thread material.

As the comparison of curves in FIG. 3 and FIG. 4 shows, owing to the movement of the reed teeth 12 according to the invention, there is a greater length for the section 28 of the weft threads running out of the shuttles 16, extending between the exit point 30 from the shuttle and the beginning 31 of the beat-up zone. This again has the advantage that this thread section 28 is given a better possibility of being stretched out and of compensating for any irregularities in the weft thread. The weft thread 28 is of maximum length if the ends of the reed teeth change as early as possible from the high speed of the tooth ends to the relatively low speed. In the region AB of their relatively high speed, they are used for driving the shuttles 16. Away from the position in which they have carried out this task, that is to say away from the position designated with reference numeral 32 in FIG. 4, they can be given a relatively low speed.

As indicated in FIG. 4, for example, the inclination of the curve 26 between positions A′ and B′ or first section can amount to 60° and between positions B′ and C′ or second section to 30° in relation to a theoretical horizontal straight line, that is to say, in the helical shafts 13, 14 the variation of the spacing of the guide surfaces 8, 9 from the axis of rotation in the part-region AB is approximately twice as great as in the part-region BC.

With further reference to FIG. 4, it should also be mentioned that it is particularly advantageous if the exit point 30 is arranged at such a spacing from the reed teeth 12 that the issuing weft thread section 28 does not come into contact with the curve 27, that is to say with the reed teeth at the beginning of the second part-region B′C′.

By slowing down the reed tooth movement by a cushion of elastic material, a further improvement is obtained towards the object of a straight regular beat-up edge on the fabric. One constructional example is shown in FIG. 1. In this, a rubber band 33 extends transversely to the reed teeth 12. Immediately before the abutment position C′ of the teeth 12, they strike against the rubber band 33 and press this inwards to a depth designated as 34.

It will be appreciated that various changes and modifications may be made within the skill of the art without departing from the spirit and scope of the invention illustrated and described herein.

What is claimed is:

1. A travelling wave-type weaving machine with reed teeth arranged along an axis and adapted to be pivoted about the said axis, the reed teeth abutting with some play on driven cam-like guide surfaces which on rotation cause pivoting movement of the reed teeth about the axis, the reed teeth producing movement of shuttles and the beating-up of the weft thread in one of the end positions of the said teeth, the said reed teeth forming in their entirety a wave-like periodic curve formed by the ends of the teeth moving towards their beat-up position, the said cam-like guide surfaces having first section and second section, said first section moving said shuttle and having a profiled guide surface that produces a substantial variation in the spacing of the guide surface from its axis of rotation, the first section merging into said second section that produces the beat-up position of the reed tooth, said second section having a profiled guide surface that immediately produces a linear variation of the spacing of the guide surface from its axis of rotation, which is less than the variation of the first section and extends to the immediate vicinity of the beat-up point so that an abrupt change in movement of the reed teeth from high speed in the first section for shuttle movement to lower speed in the second section is produced to prevent over-shooting of the reed teeth at the beat-up line.

2. The wave-type weaving machine according to claim 1 characterized in that the first section and the second section extend over at least approximately equal angles.

3. The wave-type weaving maching according to claim 1 characterized in that the variation of the spacing of the guide surfaces from the axes of rotation thereof is approximately twice as great in the first section as in the second section.

4. The wave-type weaving machine according to claim 1 wherein shuttles are provided which insert weft threads and which have a weft thread exit point situated in the rear portion of the shuttle, characterized in that the exit point is arranged at such a spacing from the reed teeth that the issuing weft thread is situated outside the space through which the reed teeth situated at the beginning of the second section move.

5. The wave-type weaving machine according to claim 1 characterized in that there is provided a band of elastic material which is arranged transversely to the reed teeth and against which the reed teeth strike to depress the elastic material to a desired extent during movement of the reed teeth into the fabric beating-up position.

* * * * *